US005311261A

United States Patent [19]

Nakagama et al.

[11] Patent Number: 5,311,261

[45] Date of Patent: May 10, 1994

[54] TONER DENSITY CONTROL METHOD FOR IMAGE RECORDING APPARATUS AND APPARATUS FOR THE SAME

[75] Inventors: Kiyohari Nakagama; Satoshi Watanabe; Mitsugu Nemoto, all of Hachioji, Japan

[73] Assignee: Konica Corporation, Tokyo, Japan

[21] Appl. No.: 962,487

[22] Filed: Oct. 15, 1992

[30] Foreign Application Priority Data

Oct. 15, 1991 [JP] Japan ..... 3-295122
Dec. 20, 1991 [JP] Japan ..... 3-355925

[51] Int. Cl.[5] ..... G03G 21/00

[52] U.S. Cl. ..... 355/246; 355/203; 355/204; 355/208; 118/689

[58] Field of Search ..... 355/203, 204, 208, 246; 118/689, 691; 221/DIG. 1

[56] References Cited

U.S. PATENT DOCUMENTS 4,916,488 4/1990 Kimura ..... 355/208
4,932,356 6/1990 Watanabe et al. ..... 118/689
4,999,676 3/1991 Mouri ..... 355/246
5,091,749 2/1992 Iida et al. ..... 355/246
5,107,301 4/1992 Yamauchi ..... 355/208
5,162,849 11/1992 Yoshino et al. ..... 355/246 X
5,164,775 11/1992 Miller et al. ..... 355/246

FOREIGN PATENT DOCUMENTS 2213274 8/1989 United Kingdom ..... 355/246

*Primary Examiner*—Matthew S. Smith
*Attorney, Agent, or Firm*—Jordan B. Bierman

[57] ABSTRACT

This invention relates to a toner density control method for an image recording apparatus including the steps of: obtaining, as a sensitivity of a toner density sensor, a change amount in output voltage of the sensor with respect to that in control voltage for controlling a strength of the magnetic field generated by the sensor; calculating a ratio of the sensitivity of the sensor to that of a standard toner density sensor, thus obtaining a correction value; discriminating which one of plurality of ranges bounded in accordance with operational results of a value of the output voltage of the standard toner density sensor and the correction value of the output voltage of the sensor belongs to, and changing a replenishing amount of the toner on the basis of a discrimination result, and relates to an apparatus for practicing the method.

6 Claims, 10 Drawing Sheets

| x | y |
|---|---|
| 1.6 | 0.4 |
| 1.61 | 0.425 |
| 1.62 | 0.45 |
| ⋮ 2.0 ⋮ | ⋮ 0.5 ⋮ |
| 2.4 | 0.6 |

TONER DENSITY CONTROL METHOD FOR IMAGE RECORDING APPARATUS AND APPARATUS FOR THE SAME

BACKGROUND OF THE INVENTION

1. Field of the Invention

The present invention relates to a toner density control method for an image recording apparatus, e.g., an electrophotographic copying machine, and an apparatus for practicing this method.

2. Description of the Prior Art

In an image recording apparatus, e.g., an electrophotographic copying machine and a facsimile apparatus, an original is irradiated with light, an electrostatic latent image is formed on a photosensitive body by light reflected by the original, and this image is recorded on recording paper in the form of a visual image, or an electrical signal representing an image supplied from outside is recorded on recording paper in the form of a visual image.

In an image recording apparatus of this type, a visual image is formed by using a two-component developing agent consisting of a toner and a carrier, and the visual image is recorded on the recording paper. A toner density affects the density of a copy image. Hence, in order to always obtain a recording image having a predetermined density, the toner density is detected and control is performed such that when the toner density is decreased, the toner is replenished so that the toner density falls within an appropriate range.

Various methods have been conventionally known to detect the toner density. For example, according to Japanese Patent Publication No. 64-5299, when a developing agent is to be replaced, a reference value serving as a reference of density control is selected by a selector switch, and toner density control is performed on the basis of the selected reference value. According to another method, the density of a toner image formed by a small piece having a reference density is optically detected. According to still another method, a magnetic field is formed by an RF voltage, this magnetic field is caused to partly affect a two-component developing agent, and a change in magnetic permeability per unit volume of the developing agent is detected, thereby detecting the toner density.

Generally, in image recording apparatuses each using a two-component developing agent, when a control system to change a toner supply amount or to stop the operation of each apparatus (in other words, to protect the apparatus) in accordance with a toner density is employed, a difference between the output value from a toner density sensor with respect to the reference toner density and the output value from the toner density sensor with respect to each toner density sometimes varies from one machine type to another. The level of the toner density needing toner replenishment varies due to this variation.

As a result, replenishment is delayed when it is needed, and the toner density of the developing agent is decreased, causing a decrease in image quality and degradation in developing agent.

FIG. 2 shows the relationship among an output voltage Vo of a toner density sensor, a substantial toner density Tc, a detected toner density Td when a control voltage (the voltage, generated by the toner density sensor, for controlling the strength of the magnetic field) Vc of a standard toner density sensor is about 7.0 V as its general value or changed to 6.75 V or 7.25 V). Referring to FIG. 2, the substantial toner density Tc is the actual toner density. Since the apparent voltage Vo obtained by the toner density sensor changes only by 0.01 V, the detected toner density Td cannot substantially detect this change. In order to change the output voltage by 0.1 V, as in the standard toner density sensor, by using this toner density sensor having a low sensitivity, the substantial toner density Tc must change to 5.0%.

For this purpose, assume that the toner density is controlled by using a toner density sensor having a low sensitivity S. Then, the recording apparatus detects that the toner density is still at a normal value of 6.0% when toner replenishment is actually needed, and the toner is not replenished. The toner is actually replenished after the substantial toner density Tc is considerably decreased. For this reason, the number of times of stirring the toner and carrier after the toner is initially replenished and before the toner is replenished next becomes larger than that obtained when the standard toner density sensor is used, and carrier particles collide to be damaged during this stirring. Then, the durability of the developing agent is degraded, and the toner is stirred before new toner replenishment (not charged since the toner is not yet stirred), causing an increase in charge amount of the toner and carrier. When the charge amount is increased, the flowability of the toner is decreased. The toner is then attached to the toner density sensor to cause erroneous detection, or the stirred toner and the newly replenished toner are not mixed well, forming toner particles (a toner mass) to be attached to the drum to contaminate the recording paper, thus disabling normal recording.

Inversely, when the sensitivity S of the toner density sensor is excessively high, despite that the toner density can originally be controlled by about 4 to 8% by using the toner density sensor, the range of the toner density control is narrowed, or the toner density sensor causes a malfunction because it can be easily affected by a power supply ripple or the noise. Although these phenomena can be prevented by increasing the capacitance of a smoothing capacitor or by using a noise filter, the toner density is largely influenced by the environmental conditions. No problem arises in toner replenishment since an appropriate amount of toner is replenished.

The above description applies to a case when the sensitivity of the toner density sensors varies. However, even in the standard toner density sensor, when originals having low densities (e.g., originals containing only ruled lines or a small number of characters) are continuously recorded, the toner consumption becomes smaller than that obtained when originals having ordinary densities are recorded, and toner replenishment to the developing chamber is not performed until the detected toner density is decreased to a predetermined value. For this reason, the number of times of stirring the developing agent after the toner is once replenished to the developing chamber and before it is replenished again becomes larger than that obtained when originals having high densities are recorded. In this case, therefore, the durability of the developing agent is degraded and the charge amounts of the toner and the developing agent are increased, in the same manner as in the case wherein the toner density sensor having the low sensitivity S is used. Then, the flowabilities of the toner and the developing agent are decreased, the toner is accumulated on the toner density sensor, or toner particles are formed to be dropped on the recording paper, thus disabling normal recording.

A toner density sensor incorporates a coil for generating a magnetic field to be applied to the two-component developing agent, and a coil for detecting a change in magnetic permeability of the developing agent by utilizing this magnetic field, and detects a density in toner from the obtained magnetic permeability.

FIG. 1 is a schematic diagram for explaining the principle of the toner density sensor.

A magnetic field generating coil La for generating a magnetic field and a detection coil Lb are arranged in the toner density sensor to oppose each other, and lines Ba of magnetic force as indicated by solid lines are generated by the coil La. If a developing agent (carrier) is present between the coils La and Lb, the paths of the lines Ba of magnetic force are changed to alternate long and short dashed lines to extend through the coil Lb. Thus, the presence and amount of a magnetic body can be detected by the coil Lb.

In testing toner density sensors before shipment, for example, a ferrite core is used as the dummy developing agent while the control voltage Vc of each toner density sensor is set at a constant value. The ferrite core is set close to the detection coil Lb, and the thickness (i.e., corresponding to the density of the developing agent) of the ferrite core serving as the dummy developing agent is changed to obtain an output voltage Vo. Only the toner density sensors, the gradients of the characteristic lines of the output voltage Vo of which fall within a predetermined range, are selected as non-defective products.

Toner density sensors that passed such a test are mounted in the image recording apparatuses on an assembly line.

However, even a toner density sensor that has passed the test and is mounted in the image recording apparatus cannot sometimes perform precise density control when used actually depending on the environmental conditions, e.g., the temperature and humidity.

Even if the toner density sensor is normal, if the user erroneously uses a developing agent available from a different company, density control cannot sometimes be sufficiently performed due to the different characteristics.

A toner density sensor used in an image recording apparatus of this type has a variation in the change amount in output voltage Vo of the toner density sensor with respect to the change amount in substantial toner density Tc, i.e., has a variation in the sensitivity S, and sometimes detects a toner density change different from the actual toner density change. When the variation in the sensitivity of the toner density sensor is small, no problem arises in controlling the toner density by using this toner density sensor. However, when the variation in the sensitivity is large, especially, when the sensitivity is excessively low, normal toner density control becomes difficult to perform.

The problem arising in toner density control by using a toner density sensor having a low sensitivity will be described with reference to FIG. 3.

Referring to FIG. 3, the axis of abscissa represents the substantial toner density Tc, and the axis of ordinate represents the output voltage Vo of the toner density sensor. The sensitivity characteristics of the standard toner density sensor are represented by a solid line (TYP in FIG. 3), and those of toner density sensors (two types) each having a low sensitivity are represented by broken lines (MIN(1) and MIN(2)) in FIG. 3. Assume that a standard toner density sensor having a sensitivity S of, e.g., 0.5 V/% (a change in output voltage Vo with respect to the substantial toner density change of 1% is 0.5 V) is used. When the detected toner density Td is changed from 6.0% to 5.8%, the output voltage Vo is increased from 1.6 V to 1.7 V by 0.1 V, as is seen from FIG. 3, and when the output voltage Vo is changed by 0.1 V, the toner is replenished so that the substantial toner density Tc becomes 6.0%, so that recording is performed at a normal density.

However, when a toner density sensor having a low sensitivity S (e.g., 0.2 V/%) is used, since its characteristic line is MIN(1), even if the detected toner density Td is similarly changed from 6.0% to 5.8%, the output voltage Vo is changed by only 0.02 V. It is difficult to detect this change. In order to change the output voltage by 0.1 V by using this toner density sensor having the low sensitivity, as the standard toner density sensor, the substantial toner density Tc must change to 5.5%. When a toner density sensor having a lower sensitivity S (0.1 V/%) is used, since its characteristic line is MIN(2), even if the detected toner density Td is similarly changed from 6.0% to 5.8%, the output voltage Vo changes only by 0.01 V. It is substantially impossible to detect this change. In order to change the output voltage by 0.1 V, as in the standard toner density sensor, by using this toner density sensor having the lower sensitivity, the substantial toner density Tc must change to 5.0%.

Assume that the toner density is controlled by using a toner density sensor having a low sensitivity S. Then, the recording apparatus detects that the toner density is still at a normal value of 6.0% even when toner replenishment is actually needed, and the toner is not replenished. The toner is actually replenished after the substantial toner density Tc is considerably decreased. For this reason, the number of times of stirring the toner and carrier after the toner is initially replenished and before the toner is replenished next becomes larger than that obtained when the standard toner density sensor is used, and carrier particles collide to be damaged during this stirring. Then, the durability of the developing agent is degraded, and the toner is stirred before new toner replenishment (not charged since the toner is not yet stirred), causing an increase in charge amount of the toner and carrier. When the charge amount is increased, the flowability of the toner is decreased. The toner is then attached to the toner density sensor to cause erroneous detection, or the stirred toner and the newly replenished toner are not mixed well, forming toner particles (a toner mass) to be attached to the drum to contaminate the recording paper, thus disabling normal recording.

Inversely, when the sensitivity S of the toner density sensor is excessively high, despite that the toner density can originally be controlled by about 4 to 8% by using the toner density sensor, the range of the toner density control is narrowed, or the toner density sensor causes a malfunction because it can be easily affected by a power supply ripple or the noise. These phenomena can be prevented by increasing the capacitance of a smoothing capacitor or by using a noise filter. Toner replenishment largely depends on environmental conditions. However, no problem arises in toner replenishment since an appropriate amount of toner is replenished.

The problem posed by different sensitivities of the toner density sensors is similarly posed when the developing agents have different compositions. This is because when the compositions of the developing agents are different from each other, the relationship between the control voltage and output voltage of the toner density sensor does not sometimes become linear.

For example, when the control voltage-output voltage characteristics of a toner density sensor is measured by using a developing agent available from a company A, the characteristic line becomes substantially vertical (the output voltage is increased only by slightly increasing the control voltage). However, when a developing agent available from a company B is used, the characteristic line is almost saturated (the output voltage is not substantially changed even if the control voltage is changed). Then, with the developing agent of the company B, not only normal toner density control cannot be performed, but also machine breakdown may occur.

SUMMARY OF THE INVENTION

The present invention has been made in view of the situation described above, and has as its first object to provide a toner density control method capable of enabling normal recording even when the sensitivity of toner density sensors varies or originals having low densities are continuously recorded.

It is the second object of the present invention to provide a toner density control apparatus capable of preventing contamination or a trouble caused by the toner even when the characteristics of the toner density sensor are changed over time or when a developing agent having more or less different physical characteristics is used.

In order to achieve the first object described above, according to the first aspect of the present invention, there is provided a toner density control method for an image recording apparatus which uses a toner density sensor for generating a magnetic field, causing the magnetic field to act on a two-component developing agent consisting of a toner and a carrier, and detecting a change in magnetic permeability of the developing agent, thereby detecting a toner density of the developing agent, and controls a toner density on the basis of an output voltage of the toner density sensor, comprising the steps of: obtaining, as a sensitivity of the toner density sensor, a change amount in output voltage of the toner density sensor with respect to a change amount in control voltage for controlling a strength of the magnetic field generated by the toner density sensor mounted in the image recording apparatus; calculating a ratio of the sensitivity of the toner density sensor to a sensitivity of a standard toner density sensor, thus obtaining a correction value; discriminating which one of a plurality of ranges bounded in accordance with operational results of a value of the output voltage of the standard toner density sensor and the correction value the value of the output voltage of the toner density sensor mounted in the image recording apparatus belongs to; and changing a replenishing amount of the toner on the basis of a discrimination result.

In order to achieve the second object of the present invention, according to the second aspect of the present invention, there is provided a toner density control apparatus of an image recording apparatus comprising a toner density sensor for generating a magnetic field, causing the magnetic field to act on a two-component developing agent consisting of a toner and a carrier, and detecting a change in magnetic permeability of the developing agent, thereby detecting a toner density of the developing agent, and control means for controlling the toner density on the basis of an output voltage of the toner density sensor, wherein the control means defines, as a sensitivity of the toner density sensor, a change amount in output voltage of the toner density sensor with respect to a change amount in control voltage for controlling a strength of the magnetic field generated by the toner density sensor, causes the image recording apparatus to perform a recording operation while performing toner replenishment when a ratio of the sensitivity of the toner density sensor to a sensitivity of a standard toner density sensor falls within a predetermined range, and causes the image recording apparatus not to perform toner replenishment but to be set in a wait mode when the ratio falls outside the predetermined range.

According to a preferred example of the second aspect, the control means comprises: a replenishment discriminating circuit for receiving the output voltage from the toner density sensor through an amplifying circuit, and setting toner replenishing motor means in an operative or non-operative state in accordance with the value of the output voltage; an operational circuit for receiving an output from the toner density sensor through the amplifying circuit and calculating a ratio of the sensitivity of the toner density sensor to the sensitivity of the standard toner density sensor; a control voltage generating circuit for generating the control voltage to be applied to the toner density sensor upon reception of an output from the operational circuit; a non-volatile memory for storing an operation result of the operational circuit; and a control voltage calculating circuit for outputting a control signal to the control voltage generating circuit upon reception of an output from the non-volatile memory.

The first aspect of the present invention described above includes the steps of: obtaining, as the sensitivity of the toner density sensor, the change amount in output voltage of the toner density sensor with respect to the change amount in control voltage for controlling the strength of the magnetic field generated by the toner density sensor mounted in the image recording apparatus; calculating the ratio of the sensitivity of the toner density sensor to the sensitivity of the standard toner density sensor, thus obtaining the correction value; discriminating which one of the plurality of ranges bounded in accordance with operational results of the value of the output voltage of the standard toner density sensor and the correction value the value of the output voltage of the toner density sensor mounted in the image recording apparatus belongs to; and changing the replenishing amount of the toner on the basis of the discrimination result. Therefore, normal recording can be performed even when the sensitivity of the toner density sensor varies or even when originals having low densities are continuously recorded.

According to the second aspect of the present invention, the change amount in output voltage of the toner density sensor with respect to the change amount in control voltage for controlling the strength of the magnetic field generated by the toner density sensor is defined as the sensitivity of the toner density sensor, the ratio of the sensitivity of the toner density sensor to the sensitivity of the standard toner density sensor is calculated, the image recording apparatus is caused to perform the recording operation while performing toner replenishment when this ratio falls within the predetermined range, and the image recording apparatus is caused not to perform toner replenishment but to be set in the wait mode when the ratio falls outside the predetermined range. Therefore, the toner is not replenished even when the characteristics of the toner density sensor are changed over time or a developing agent having different characteristics is used, thereby preventing contamination or troubles caused by the toner.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

The present invention will be described by way of several preferred embodiments shown in the accompanying drawings. Note that in the embodiments, the method and apparatus of the present invention are applied to toner control of an electrophotographic copying machine.

Figure 4:
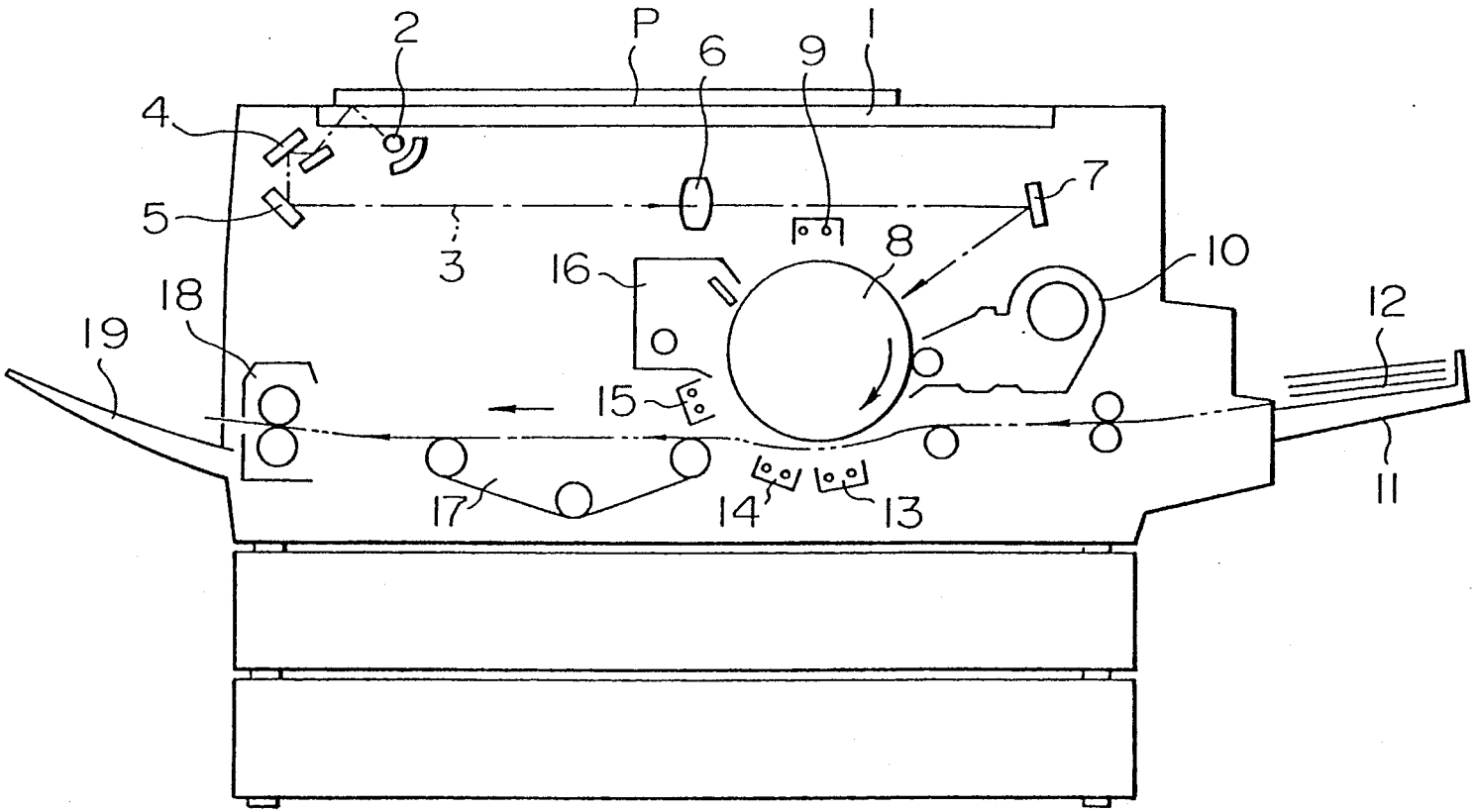
FIG. 4 is a schematic diagram showing the arrangement of an electrophotographic copying machine to which the toner density control method for an image recording apparatus according to the present invention is applied.

FIG. 4 schematically shows the arrangement of an electrophotographic copying machine as an example of an image recording apparatus. An original P placed on an original table 1 of the electrophotographic copying machine is irradiated with a radiation lamp 2. The light 3 indicated by an alternate long and short dashed line in FIG. 4 which is reflected by the original P is reflected by first and second mirrors 4 and 5, and is then reflected by a third mirror 7 through a lens 6 and projected on a photosensitive drum (to be merely referred to as a drum hereinafter) 8, thus forming an electrostatic latent image of the original P on the drum 8. A charging electrode 9, a developing unit 10, a transfer electrode 13, a separation electrode 14, a discharging electrode 15, and a cleaning unit 16 are arranged around the drum 8. The charging electrode 9 uniformly charges the photosensitive body formed on the surface of the drum 8. The developing unit 10 develops the electrostatic latent image formed on the photosensitive body to obtain a visual image (toner image). The transfer electrode 13 transfers the visual image on copy paper 12 fed from a paper feed cassette 11 through a path indicated by an alternate long and two short dashed line. The separation electrode 14 separates the copy paper 12 on which the visual image is transferred from the drum 8. The discharging electrode 15 removes the charges remaining on the photosensitive body. The cleaning unit 16 removes the toner remaining on the photosensitive body after discharge. The copy paper 12 separated from the drum 8 after transfer along the path indicated by the alternate long and two short dashed line is conveyed to a fixing unit 18 by a convey roller 17. The toner in the copy paper 12 is thermally fused in the fixing unit 18 to be fixed on the copy paper 12. Then, the copy paper 12 is discharged to a paper discharge tray 19.

Figure 5:
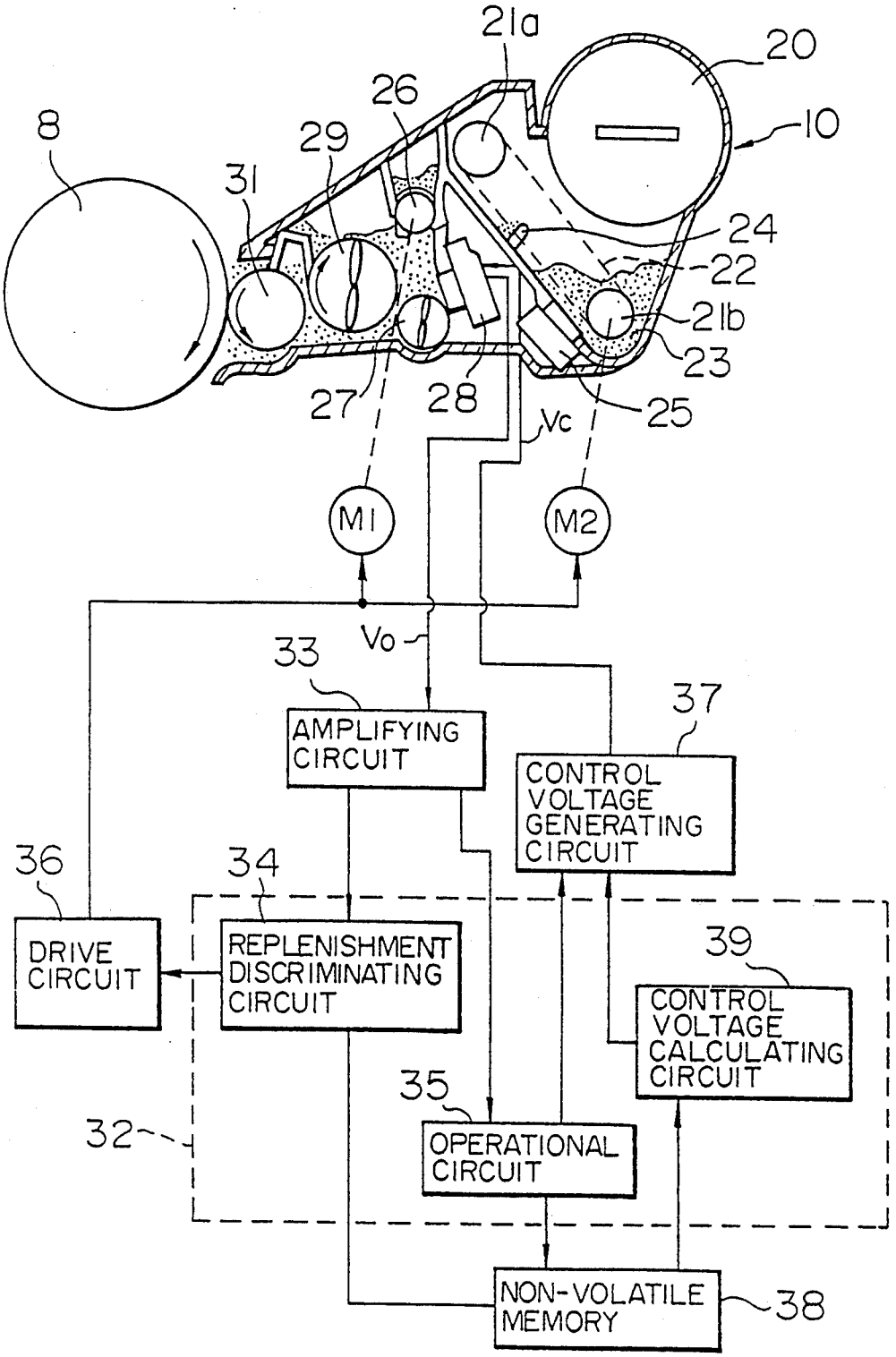
FIG. 5 is a combination of the schematic diagram of the developing unit of the electrophotographic copying machine shown in FIG. 4 and the block diagram of a controller for performing toner density control.

FIG. 5 is a block diagram of the developing unit and the control circuit of the electrophotographic copying machine shown in FIG. 4.

A toner cartridge 20 houses a two-component developing agent 23 consisting of the toner and carrier. Two rotatable ladder wheels 21*a* and 21*b* are disposed at an obliquely lower front portion of the toner cartridge 20. A ladder chain 22 is wound on the ladder wheels 21*a* and 21*b*. A convey plate 24 for picking up the developing agent 23 is mounted on the ladder chain 22. A toner balance sensor 25 for detecting the balance of the developing agent 23 is disposed in the vicinity of the lower ladder wheel 21*b*. A replenishing roller 26 is mounted at an obliquely lower front portion of the upper ladder wheel 21*b* to be rotatable about the axis thereof. An auxiliary stirring plate 27 for stirring the developing agent 23 is disposed below the replenishing roller 26 to be rotatable about the axis thereof.

When the replenishing roller 26 is rotated, a predetermined amount (corresponding to the rotation time; e.g., about 20 to 40 mg when the original has a low density) of substantially non-charged toner is replenished to the developing chamber and mixed with the pre-existing toner. As a result, an increase in total charge amount in the developing chamber is suppressed. When the original has a high density, the toner consumption is increased. Accordingly, the rotation time of the replenishing roller 26 is increased to compensate for this increase, and e.g., about 80 mg of toner is replenished to perform recording at a normal density.

A toner density sensor 28 for detecting the density of the developing agent 23 is disposed between the replenishing roller 26 and the auxiliary stirring plate 27. A stirring plate 29 for further stirring the developing agent 23 stirred by the auxiliary stirring plate 27 is disposed adjacent to the auxiliary stirring plate 27. A developing sleeve 31 is disposed in front of the stirring plate 29 to be adjacent to the drum 8.

The toner density sensor 28 incorporates a coil for generating a magnetic field to be applied to the developing agent 23 present between the replenishing roller 26 and the auxiliary stirring plate 27, and a coil for detecting a change in magnetic permeability of the developing agent 23 by utilizing this magnetic field. An output from the toner density sensor 28 is input to a replenishment discriminating circuit 34 and an operational circuit 35 of a CPU 32 through an amplifying circuit 33.

The replenishment discriminating circuit 34 is connected to a drive circuit 36 for driving motors M1 and M2. The motors M1 and M2 are driven by the drive circuit 36 in accordance with the value of an output voltage Vo of the toner density sensor 28. That is, when the output voltage Vo becomes higher than the preset value, e.g., higher than 1.6 V, a detected toner density Td is decreased, and the replenishment discriminating circuit 34 sends a signal to the drive circuit 36 to designate it to drive the motors M1 and M2. As a result, the motors M1 and M2 are driven, the replenishing roller 26 coupled to the motor M1 and the ladder wheels **21*a* and 21*b* coupled to the motor M2 are rotated, and an amount of toner corresponding to a rotation time Tr of each of the roller 26 and the ladder wheels 21*a* and 21*b* is replenished. When the rotation time Tr of the motors M1 and M2** is long (e.g., 1,450 msec), a large amount of (e.g., 200 mg) toner is replenished; when the rotation time Tr is short (e.g., 800 msec), a small amount of (e.g., 150 mg) toner is replenished; and when the rotation time Tr is shorter (e.g., 150 msec), a smaller amount of (e.g., 100 mg) toner is replenished.

In contrast to this, when the output voltage Vo of the toner density sensor 28 is lower than the present voltage of 1.6 V, the detected toner density Td is increased, and a signal designating to stop the motors M1 and M2 is sent to the drive circuit 36. As a result, the motors M1 and M2 are not rotated, and the toner is not replenished.

The operational circuit 35 calculates a sensitivity Sy (Sh, S1) of the toner density sensor 28, a ratio of the sensitivity Sy to a sensitivity Ss of a standard toner density sensor, that is, a correction value M (Mh, M1≧0), and voltages (1.6−0.1×M, 1.6, 1.6+0.1×M to be described later) as boundary values of the ranges of the change in output voltage Vo of the toner density sensor 28 mounted in the image recording apparatus on the basis of the product of a predetermined value of 0.1 and the correction value M and the value of the output voltage Vo of the standard toner density sensor. When the replenishing amount of the toner is controlled in accordance with the range to which the output voltage Vo belongs, more precise toner density correction is performed. That is, the operational circuit 35 discriminates whether the correction value M falls within a predetermined range, e.g., $0.5<M<2$. The sensitivity Sh is the sensitivity obtained when the detected toner density Td is higher than the standard toner density (6.0%), and the sensitivity S1 is the sensitivity of the toner density sensor 28 obtained when the detected toner density Td is lower than the standard toner density.

Calculation for obtaining the correction value M is performed in the following manner.

The sensitivity Sh of the toner density sensor 28 is obtained in accordance with the following equation (1):

$$Sh=(Vo_2-Vo_1)/(Vc_2-Vc_1) \quad (1)$$

where $Vo_1$ is the output voltage of the toner density sensor when a control voltage Vc is $Vc_1$ (e.g., 6.5 V), and $Vo_2$ is the output voltage of the toner density sensor 28 when the control voltage Vc is $Vc_2$ (e.g., 7.0 V). Substitutions of $Vc_1=6.5$ V and $Vc_2=7.0$ V in equation (1) yield:

$$Sh=(Vo_2-Vo_1)/0.5=2(Vo_2-Vo_1) \quad (2)$$

The sensitivity S1 obtained when the detected toner density Td is lower than the standard toner density is obtained in accordance with following equation (3):

$$S1=(Vo_3-Vo_2)/(Vc_3-Vc_2) \quad (3)$$

where $Vo_2$ is the output voltage of the toner density sensor 28 obtained when the control voltage Vc is $Vc_2$ (7.0 V), and $Vo_3$ is the output voltage of the toner density sensor 28 obtained when the control voltage Vc is $Vc_3$ (e.g., 7.5 V). Substitutions of $Vc_2=7.0$ V and $Vc_3=7.5$ V in equation (3) yield:

$$S1=(Vo_3-Vo_2)/0.5=2(Vo_3-Vo_2) \quad (4)$$

The correction value M is the correction value for the sensitivity of the toner density sensor 28 obtained when the output voltage Vo of the toner density sensor 28 takes the standard value ($Vo_{10}=1.1$ V, $Vo_{20}=1.6$ V), and a correction value Mh for a case when the detected toner density Td is higher than the standard toner density is obtained in accordance with following equation (5):

$$\left.\begin{aligned} Mh &= 2(Vo_2-Vo_1)/2(Vo_{20}-Vo_{10}) \\ &= 2(Vo_2-Vo_1)/2\times 0.5 \\ &= 2(Vo_2-Vo_1) \end{aligned}\right\} \quad (5)$$

The correction value M1 for a case when the detected toner density Td is lower than the standard toner density is obtained in accordance with following equation (6):

$$M1=2(Vo_3-Vo_2) \quad (6)$$

The operational circuit 35 controls the control voltage Vc to be applied to the toner density sensor 28 through a control voltage generating circuit 37 and sends the respective calculated values to a non-volatile memory 38 to be stored therein.

Table 1 shows an example of the variation in sensitivity S of each of five toner density sensors (sensor Nos. 1 to 5).

TABLE 1

| Sensor No. | (Change in Output Voltage Vo)/(Change in Toner Density) x (Vc = 7 V) | (Change in Output Voltage Vo)/(Change in Control Voltage Vc) y (Tc = 6.0%) |
|---|---|---|
| 1 | 0.40 | 1.6 |
| 2 | 0.45 | 1.8 |
| 3 | 0.50 | 2.0 |

TABLE 1-continued

| Sensor No. | (Change in Output Voltage Vo)/(Change in Toner Density) x (Vc = 7 V) | (Change in Output Voltage Vo)/(Change in Control Voltage Vc) y (Tc = 6.0%) |
|---|---|---|
| 4 | 0.55 | 2.2 |
| 5 | 0.60 | 2.4 |

Note that Vc=7 V indicates that Vc is a value of about 7 V (6.75 V to 7.25 V) and that Tc=6.0% indicates that Tc is a value of about 6.0% (5.0% to 7.0%).

Figure 6:
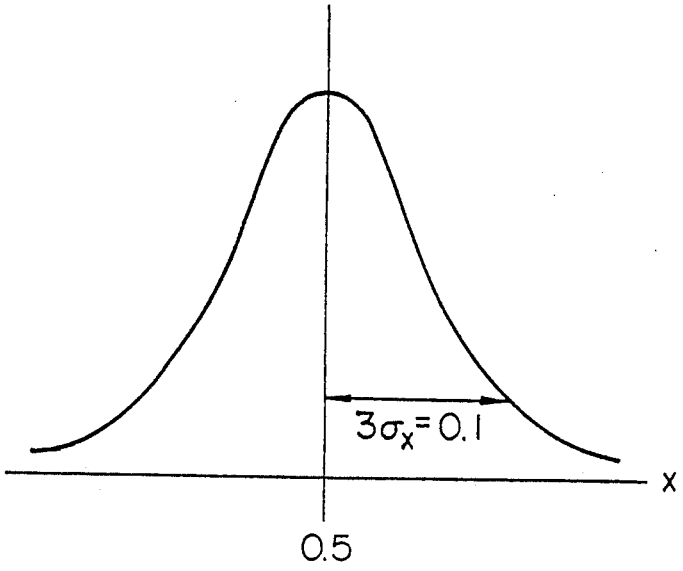
FIG. 6 is a graph for showing the distribution of $\bar{x}$ where $\bar{x}$ is a change in output voltage of the toner density sensor with respect to a toner density change.
Figure 7:
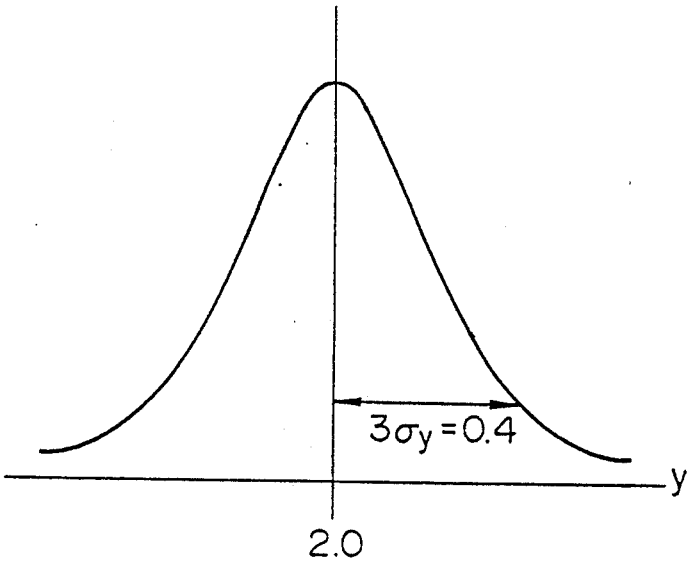
FIG. 7 is a graph for showing the distribution of $\bar{y}$ where $\bar{y}$ is a change in output voltage of the toner density sensor with respect to the control voltage of the toner density sensor.

When the distributions of the variation of the values (x and y) of the toner density sensor 28 described above are examined, they have normal distributions as shown in FIGS. 6 and 7. FIG. 6 shows the distribution of x, in which the average value of x is 0.5 and $3\sigma$ is 0.1. FIG. 7 shows the distribution of y, in which the average value of y is 2.0 and $3\sigma$ is 0.4.

When the correlationship between the values of x and y indicated in Table 1 is to be obtained, since a correlation coefficient Y is substantially equal to 1, x and y can be determined to have linear correlation. Thus, the relationship between the sensitivity S(y) of the toner density sensor with respect to the toner density and the sensitivity S(x) of the toner density sensor with respect to the control voltage Vc can be represented by following equation (7) and FIG. 8.

Figures 8, 9:
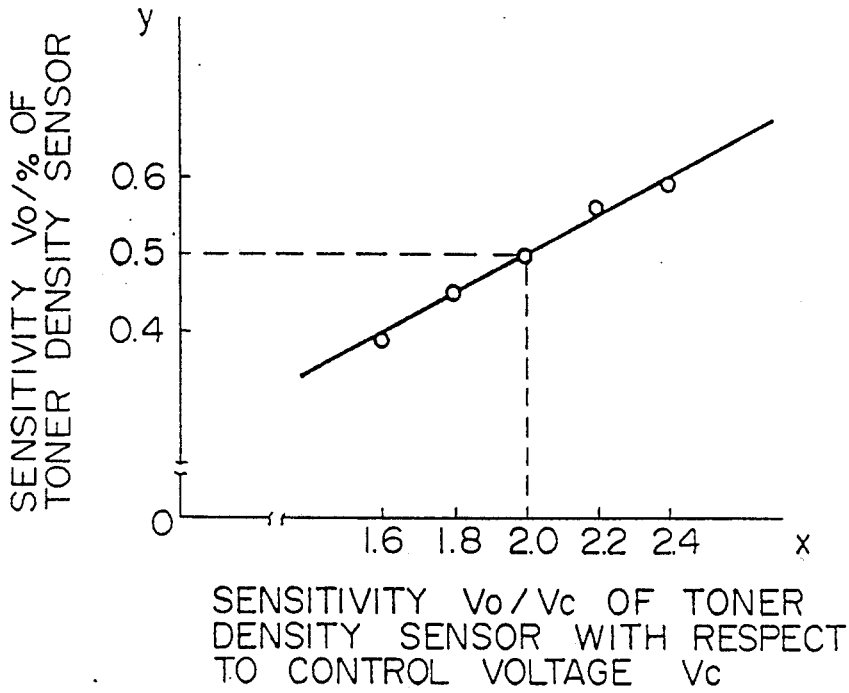
FIG. 8 is a graph for showing the relationship between maximum x in the distribution of FIG. 6 and maximum y in the distribution of FIG. 7.
FIG. 9 is a table of the values of y when x in the graph of FIG. 8 is increased from 1.6 to 2.4 every 0.01.

FIG. 8 is a graph for showing the relationship between maximum x in the distribution of FIG. 6 and maximum y in the distribution of FIG. 7.

$$y=0.25x \tag{7}$$

FIG. 9 is a table of the values of y when x represented by equation (7) is increased from 1.6 to 2.4 every 0.01. These data are stored in the non-volatile memory 38.

The non-volatile memory 38 comprises, e.g., a RAM (Random Access Memory), stores the standard toner density, the data indicating the relationship between the control voltage Vc of the toner density sensor 38 and the output voltage Vo, the correction value M, data on the toner replenishing amount according to the correction amount M, the sensitivity Ss of the standard toner density sensor, other calculated values, and the like, and outputs the calculated values to a control voltage calculating circuit 39.

The control voltage calculating circuit 39 reads out data indicating the relationship between the control voltage Vc of the standard toner density sensor and the output voltage Vo of the toner density sensor 28, calculates the control voltage Vc from the sensitivities Sh and S1 and the correction values Mh and M1, and sends a signal to the control voltage generating circuit 37 to cause it to generate the control voltage Vc.

Figure 10:
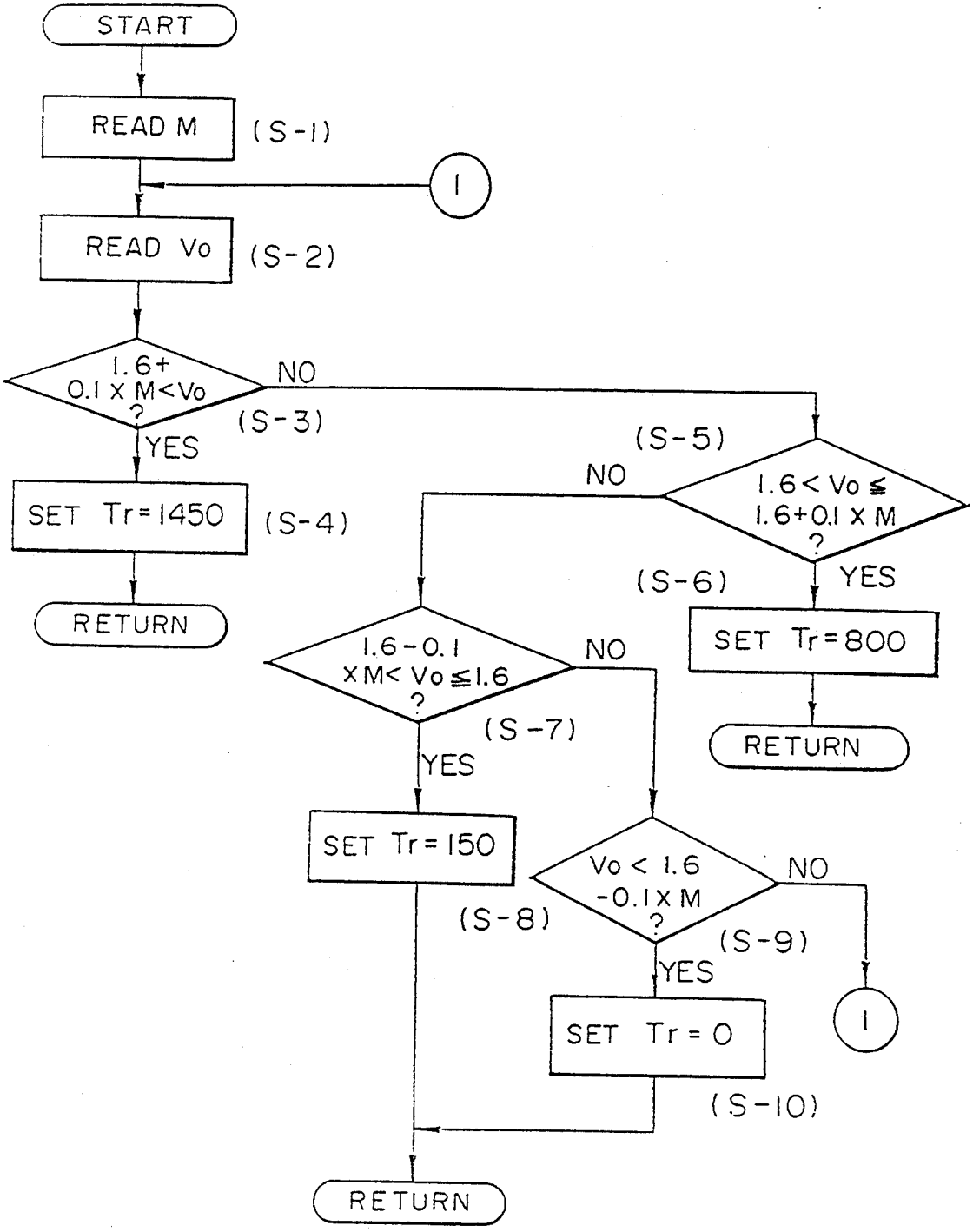
FIG. 10 is a flow chart for explaining the toner density control method of the image recording apparatus according to the present invention.
Figure 11:
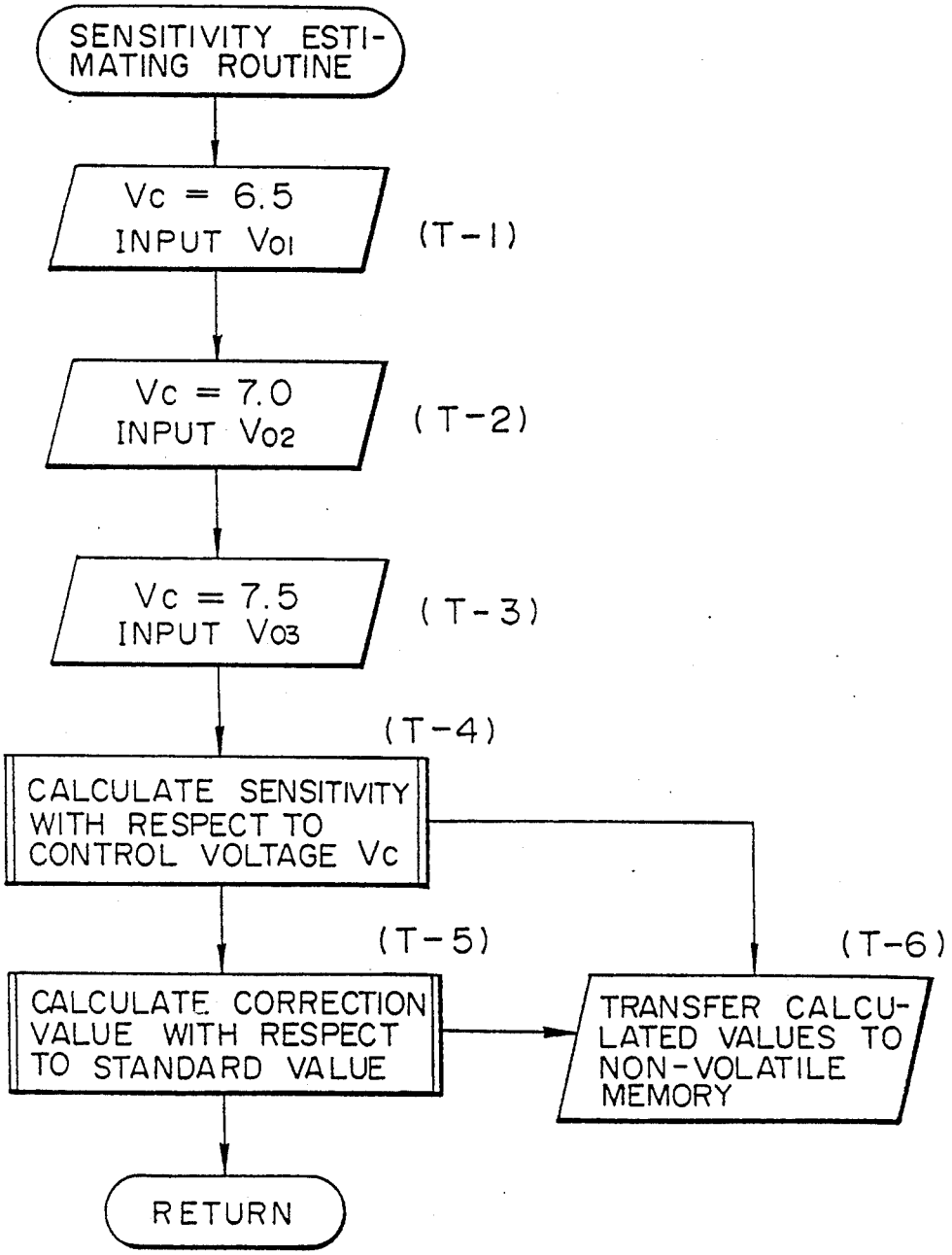
FIG. 11 is the subroutine of the flow chart of FIG. 10.
Figure 12:
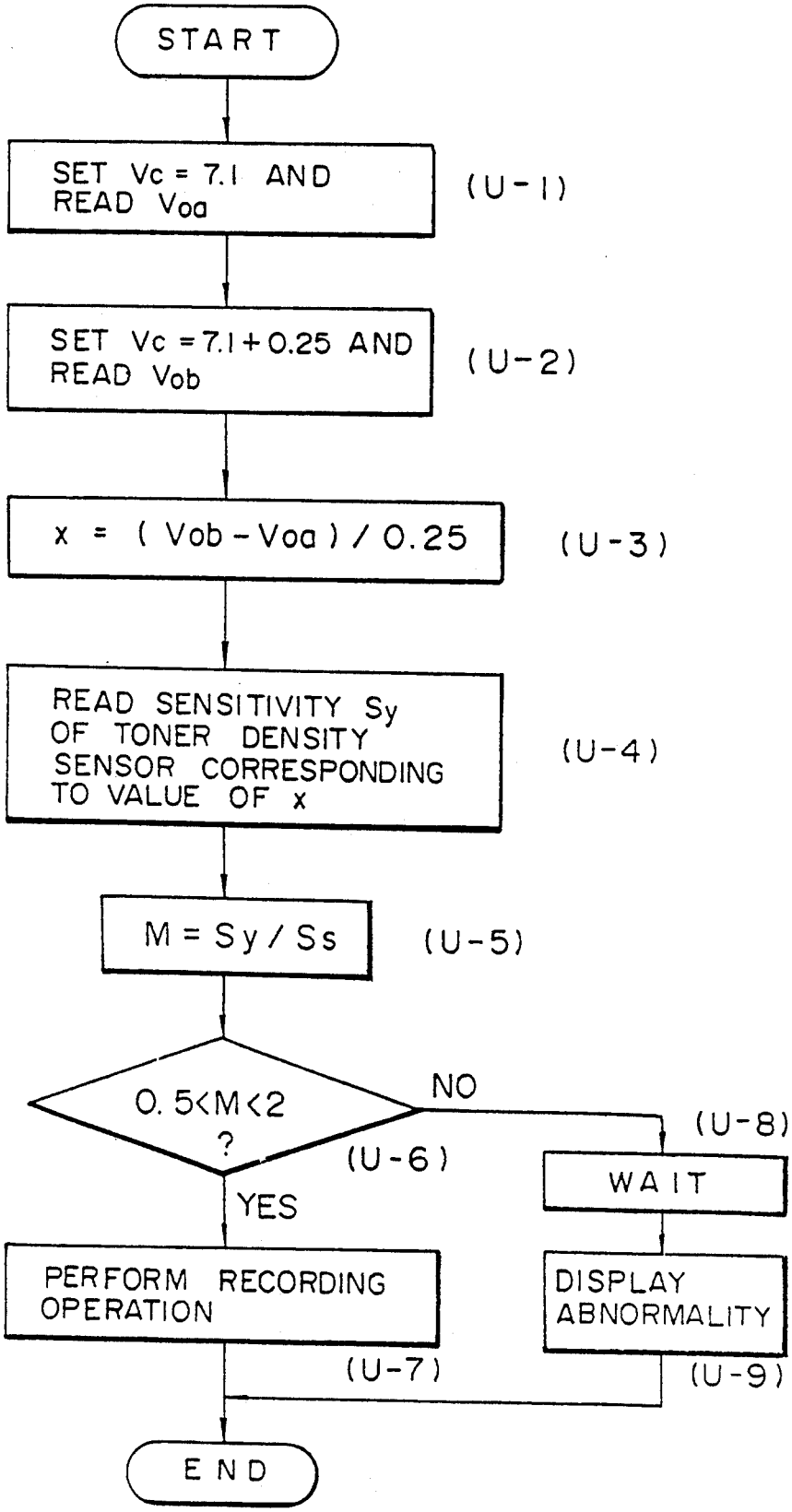
FIG. 12 is the subroutine of the flow chart of FIG. 11 and explains the operation of the image recording apparatus.

The operation of the electrophotographic copying machine having the arrangement as described above will be described with reference to the flow charts of FIGS. 10 to 12. FIG. 10 shows a main routine describing the operation of toner density control according to an embodiment of the present invention; FIG. 11 shows a sensitivity estimating routine; and FIG. 12 shows a flow chart indicating a practical example of sensitivity calculation and correction value calculation.

(1) Operation Before Recording Operation

At the start of the copying machine before a recording operation, such as loading or replacement of the developing agent for the first time in the copying machine, when the power switch is turned on, the CPU 32 measures the relationship between the control voltage and the output voltage of the toner density sensor 28 in advance, stores the relationship in the non-volatile memory 38, estimates the sensitivity S of the toner density sensor 28 from the data obtained by measurement, calculates a correction amount, and transfers the obtained data to the non-volatile memory 38.

Referring to FIG. 11, the output voltage $Vo_1$ obtained by setting the control voltage Vc to 6.5 V (T-1), the output voltage $Vo_2$ obtained by setting the control voltage Vc to 7.0 V (T-2), and the output voltage $Vc_3$ obtained by setting the control voltage Vc to 7.5 V (T-3) are input in the CPU 32. The CPU 32 calculates the sensitivity S with respect to the control voltage Vc from the obtained data (T-4) and transfers the sensitivity S to the non-volatile memory 38 (T-6). The CPU 32 also calculates the correction value for the standard values (e.g., control voltage Vc=7.0 V and the output voltage Vo=1.6 V) (T-5) and transfers it to the non-volatile memory 38 (T-6). The calculation of steps (T-4) and (T-5) is shown in the flow chart of FIG. 12. Steps (U-1) to (U-4) of FIG. 12 correspond to step (T-4) of FIG. 11, and step (U-5) of FIG. 12 corresponds to step (T-5) of FIG. 11.

Referring to FIG. 12, the control voltage Vc is set to 7.1 V in step (U-1) so that the output voltage Vo becomes 1.6 V. This aims at obtaining a median when the substantial toner density Tc is 6.0%. In the standard toner density sensor (an average product showing the standard value described above), the control voltage Vc is 7.0 V. When Vc=7.0 is set, an output voltage Voa (e.g., 1.6 V) is read, and an output voltage Vob (e.g., 2.0 V) for a case when the control voltage Vc is changed by a predetermined voltage ΔVca (+0.25 V) is read (U-2). This is due to the following reason. When the sensitivity S is to be measured, although the substantial toner density Tc of the developing agent must be changed, it is cumbersome to change it. Thus, the control voltage Vc is increased by 0.25 V in place of changing the substantial toner density Tc of the developing agent, thereby creating a state in which the substantial toner density Tc is nearly 5%. In the standard toner density sensor, the output voltage Vo is 2.1 V.

In step (U-3), the sensitivity S(x) of the control voltage Vc is calculated in accordance with following equation (8):

$$x=(Vob-Voa)/0.25 \tag{8}$$

Substitutions of Voa=1.6 and Vob=2.0 in equation (8) yield:

$$x=(2.0-1.6)/0.25=1.6 \tag{9}$$

In step (U-4), the sensitivity Sy (0.4) of the toner density sensor 28 corresponding to the value of x (the value obtained when x=1.6, i.e., y=0.4) obtained in accordance with equation (8) is read out from the table in the non-volatile memory 38. In the standard toner density sensor, x=2.0 and y=0.5 from equation (10);

$$x=(2.1-1.6)/0.25=2 \tag{10}$$

The correction value M for a case when the sensitivity Ss of the standard toner density sensor is set at 1.0 is obtained in accordance with following equation (11):

$$M = Sy/Ss \quad (11)$$

When Sy=0.4 and Ss=0.5 are substituted in equation (11), the correction value M is 0.8 (U-5).

Figure 1:
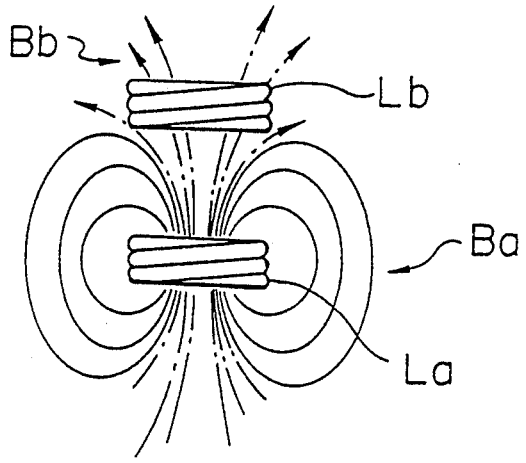
FIG. 1 PRIOR ART
FIG. 1 is a schematic diagram for explaining the principle of a toner density sensor.
Figure 2:
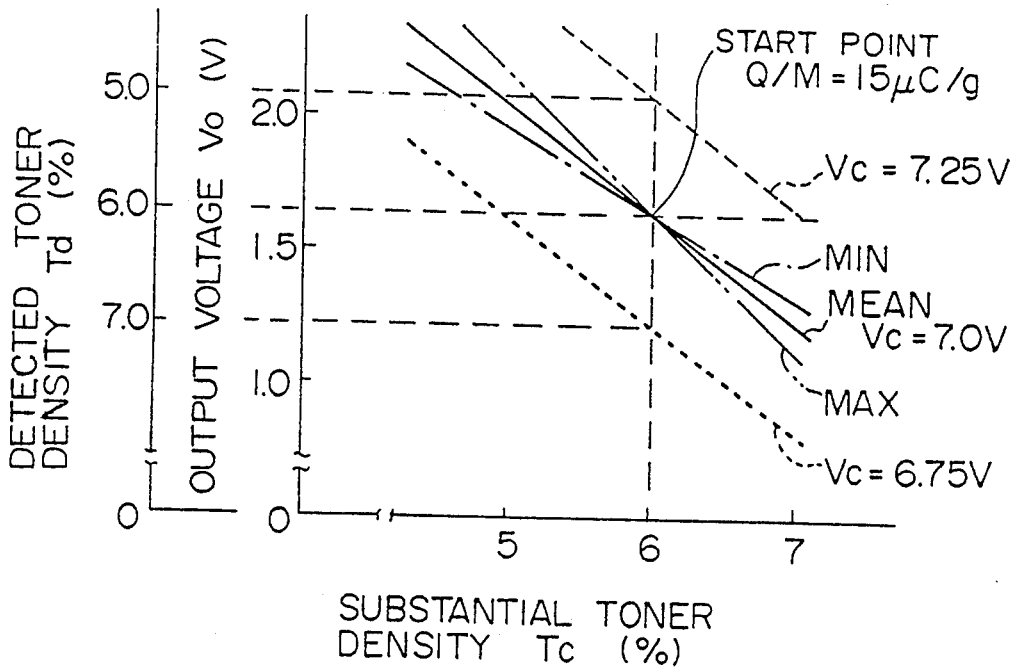
FIG. 2 is a graph for showing the relationship between the output voltage of the toner density sensor and the substantial toner density of a developing agent and between the detected toner density and the substantial toner density when the control voltage of the toner density sensor is set at a constant value.
Figure 3:
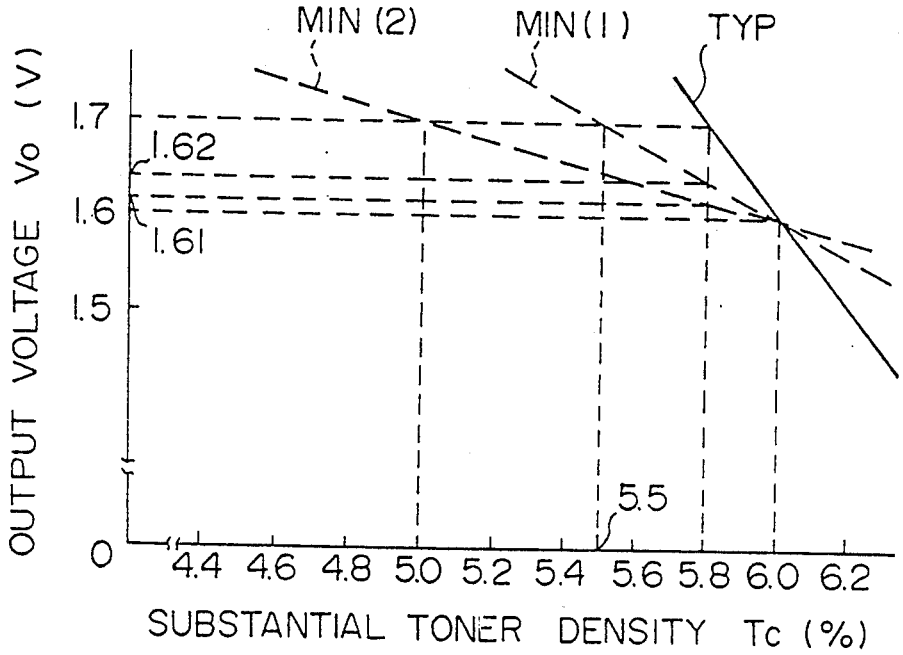
FIG. 3 is a graph for explaining a case in which the sensitivity of the toner density sensor is lower than that of a standard toner density sensor.

The sensitivity S and the correction value M obtained in this manner are stored in the non-volatile memory 38. Then, for example, the gradient of the characteristic line indicated by the broken line (MIN) in FIG. 3 can be corrected to the gradient indicated by the solid line (TYP).

Then, in step (U-6), it is discriminated whether the correction value M falls within $0.5<M<2$. If YES in step (U-6), the image recording apparatus is caused to perform a normal recording operation while toner is being replenished (U-7). If NO in step (U-6), toner replenishment is stopped, the image recording apparatus is set in the wait mode (U-8), and abnormality display is performed by a display 42 (U-9).

(2) Operation During Recording

Referring to FIG. 10, when the copy button is depressed, the copying machine starts a recording operation, and the CPU 32 of the copying machine reads out the standard control voltage (e.g., the output voltage Vo of 1.6 V of the toner density sensor 28 and the control voltage Vc of 7.00 V of the toner density sensor 28) stored in the non-volatile memory 38. The CPU 32 of the copying machine reads the correction value M for the sensitivity from the non-volatile memory 38 (S-1) and the output voltage Vo of the toner density sensor 28 (S-2).

Upon reading the output voltage Vo, in step (S-3), the CPU 32 discriminates whether the output voltage Vo is larger than $1.6+0.1\times M$. If YES in step (S-3), the rotation time Tr of the replenishing roller 26 is set to 1,450 msec, and the replenishing roller 26 is rotated for 1,450 msec. In this case, recording of an original having a high density is being performed, and about 200 mg of the toner is replenished to compensate for the lack of the toner consumed by this recording (S-4).

If NO in step (S-3), the flow advances to step (S-5), and the CPU 32 discriminates whether the output voltage Vo falls within the range of $1.6<Vo\leqq 1.6+0.1\times M$. If YES in step (S-5), the rotation time Tr of the replenishing roller 26 is set to 800 msec, and the replenishing roller 26 is rotated for 800 msec. In this case, recording of an original having a medium density is being performed, and about 150 mg of the toner are replenished (S-6).

If NO in step (S-5), the flow advances to step (S-7), and the CPU 32 discriminates whether the output voltage Vo falls within the range of $1.6-0.1\times M<Vo\leqq 1.6$. If YES in step (S-7), the rotation time Tr of the replenishing roller 26 is set to 150 msec, and the replenishing roller 26 is rotated for 150 msec. In this case, recording of originals having low densities is continuously being performed, and about 100 mg of the toner are replenished (S-8).

If NO in step (S-7), the flow advances to step (S-9), and the CPU 32 discriminates whether the output voltage Vo falls within the range of $Vo<1.6-0.1\times M$. If YES in step (S-9), the rotation time Tr of the replenishing roller 26 is set to 0, that is, the replenishing roller 26 is stopped. This occurs when the amount of toner is excessive, and no toner is replenished in this case (S-10).

In accordance with these operations, a correct replenishing amount of toner is replenished based on the correction value M for the sensitivity S of the toner density sensor 28 and the output voltage Vo of the toner density sensor 28, and the recording density is corrected to the normal level.

Figure 13:
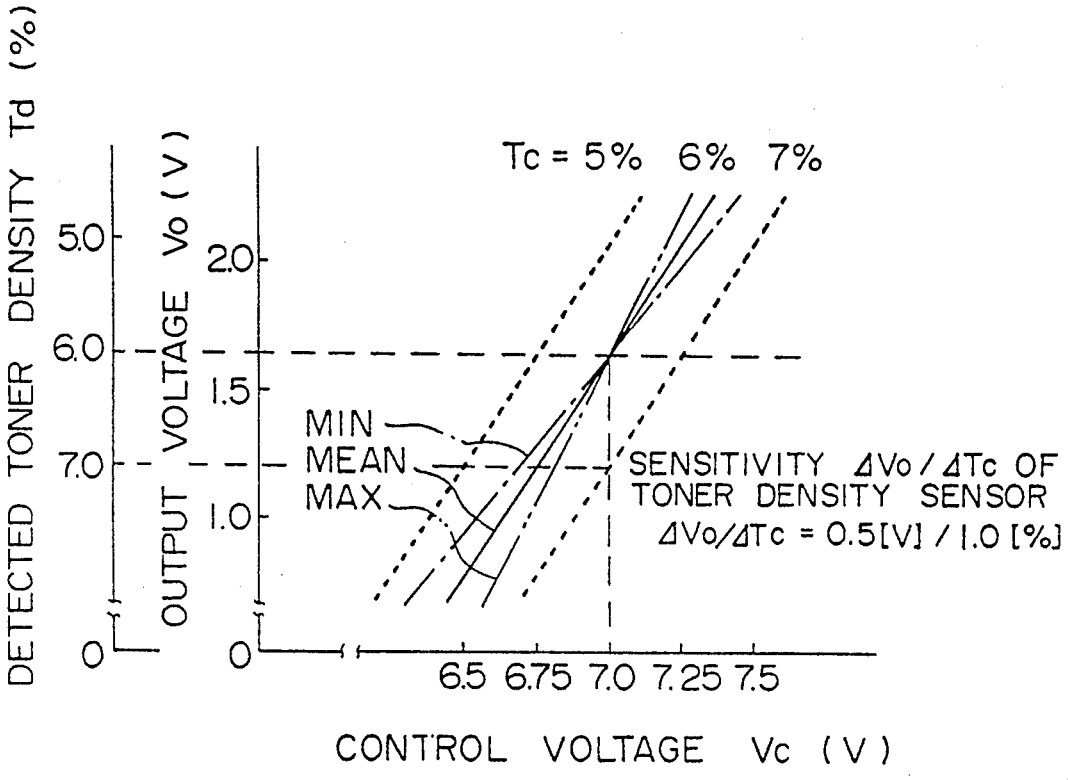
FIG. 13 is a graph for showing the relationship among the output voltage of the toner density sensor, the control voltage, and the detected toner density when the substantial toner density of the developing agent is set at a constant value.

FIG. 13 is a graph for showing the relationship among the output voltage Vo of the toner density sensor, the control voltage Vc, and the detected toner density when the substantial toner density of the developing agent is set at a constant value.

In this manner, according to the present invention, the control voltage Vc for controlling the strength of the magnetic field for the toner density sensor 28 is changed at the start of the copying machine. The change amount in output voltage Vo of the toner density sensor 28 with respect to a change amount in control voltage Vc is defined as the sensitivity Sy. The ratio Sy/Ss of the sensitivity Sy to the sensitivity Ss of the standard toner density sensor is calculated and stored in the non-volatile memory 38 as the correction value M. The electrostatic latent image formed on the photosensitive drum 8 is developed by the two-component developing agent. In this case, if the output voltage Vo of the toner density sensor 28 that varies in accordance with the density of the original satisfies $1.6+0.1\times M<Vo$, the replenishing roller 26 is rotated at the speed of 1,450 msec. If the output voltage Vo satisfies $1.6<Vo\leqq 1.6+0.1\times M$, the replenishing roller 26 is rotated at the speed of 800 msec. If the output voltage Vo satisfies $1.6-0.1\times M<Vo\leqq 1.6$, the replenishing roller 26 is rotated at the speed of 150 msec. If the output voltage Vo satisfies $Vo<1.6-0.1\times M$, rotation of the toner replenishing roller 26 is stopped. As a result, normal recording can be performed even if the sensitivity S of the toner density sensor 28 varies or originals having low densities are continuously recorded.

Whether the correction value M falls within the range of $0.5<M<2$ is discriminated. If YES, the image recording apparatus is caused to perform a normal recording operation while toner replenishment is being performed. If NO, toner replenishment is stopped, the image recording apparatus is set in the wait mode, and the abnormality is displayed by the display 42. Therefore, when the characteristics of the toner density sensor 28 mounted in the image recording apparatus is changed over time or a developing agent having a different composition is replenished, toner replenishment is not performed, so that contamination or troubles caused by the toner can be prevented.

In this embodiment, the range of the ratio M is defined as $0.5<M<2$. However, the present invention is not limited to this.

Furthermore, in this embodiment, whether the toner should be replenished is discriminated on the basis of the output voltage Vo of the toner density sensor 28 with reference to 1.6, $1.6+0.1\times M$, and $1.6-0.1\times M$ as boundary values, and the rotation time Tr of the replenishing roller 26 is set to 1,450 msec, 800 msec, 150 msec, and 0 msec. However, the present invention is not limited to them.

What is claimed is:

1. A toner density control method for an image recording apparatus which uses a toner density sensor for generating a magnetic field, causing the magnetic field to act on a two-component developing agent consisting of a toner and a carrier, and detecting a change in magnetic permeability of the developing agent, thereby detecting a toner density of the developing agent, and controls a toner density on the basis of an output voltage of said toner density sensor, comprising the steps of:

obtaining, as a sensitivity of said toner density sensor, a change amount in output voltage of said toner density sensor with respect to a change amount in control voltage for controlling a strength of the magnetic field generated by said toner density sensor mounted in said image recording apparatus;

calculating a ratio of the sensitivity of said toner density sensor to a sensitivity of a standard toner density sensor, thus obtaining a correction value;

discriminating which one of a plurality of ranges bounded in accordance with operational results of a value of the output voltage of said standard toner density sensor and the correction value the value of the output voltage of said toner density sensor mounted in said image recording apparatus belongs to; and changing a replenishing amount of the toner on the basis of a discrimination result.

2. A toner density control apparatus of an image recording apparatus comprising a toner density sensor for generating a magnetic field, causing the magnetic field to act on a two-component developing agent consisting of a toner and a carrier, and detecting a change in magnetic permeability of the developing agent, thereby detecting a toner density of the developing agent, and control means for controlling the toner density on the basis of an output voltage of said toner dens wherein said control means for defining, as a sensitivity of said toner density sensor, a change amount in output voltage of said toner density sensor with respect to a change amount in control voltage for controlling a strength of the magnetic field generated by said toner density sensor, for causing said image recording apparatus to perform a recording operation while performing toner replenishment when a ratio of the sensitivity of said toner density sensor to a sensitivity of a standard toner density sensor falls within a predetermined range, and for causing said image recording apparatus not to perform a recording operation but to be set in a wait mode when the ratio falls outside the predetermined range.

3. An apparatus according to claim 2, wherein said control means comprises:

a replenishment discriminating circuit for receiving the output voltage from said toner density sensor through an amplifying circuit, and setting toner replenishing motor means in an operative or non-operative state in accordance with the value of the output voltage;

an operational circuit for calculating a ratio (correction value) of the sensitivity of said toner density sensor to the sensitivity of said standard toner density sensor;

a control voltage generating circuit for generating the control voltage to be applied to said toner density sensor upon reception of an output from said operational circuit;

a non-volatile memory for storing an operation result of said operational circuit; and a control voltage calculating circuit for outputting a control signal to said control voltage generating circuit upon reception of an output from said non-volatile memory.

4. An apparatus according to claim 2, wherein said operational circuit calculates a voltage value as a boundary of the change in output voltage of said toner density sensor mounted in said image recording apparatus on the basis of a product of a predetermined value and the correction value and the value of an output voltage of said standard toner density sensor, and controls a replenishing amount of the toner in accordance with the range to which the output voltage of said toner density sensor belongs.

5. An apparatus according to claim 2, wherein said non-volatile memory comprises a RAM, stores a standard toner density, data representing a relationship between the control voltage and output voltage of said toner density sensor, the correction value, data on the toner replenishing amount according to the correction value, the sensitivity of said standard toner density sensor, calculated values, and the like, and outputs the calculated values to said control voltage calculating circuit in response to a designation by said operational circuit.

6. An apparatus according to claim 2, wherein said control voltage calculating circuit reads out data stored in said non-volatile memory and representing a relationship between the control voltage of said standard toner density sensor and the output voltage of said toner density sensor, calculates the control voltage from the sensitivity of said toner density sensor and the correction value, and outputs a signal to said control voltage generating circuit to generate the control voltage.

* * * * *